US008721779B2

(12) United States Patent
Jeong et al.

(10) Patent No.: US 8,721,779 B2
(45) Date of Patent: May 13, 2014

(54) CEILING EMBEDDED TYPE AIR CONDITIONER

(75) Inventors: Jae Youl Jeong, Gyeonggi-do (KR); Jin Wook Yoon, Gyeonggi-do (KR); Sin Ae Kim, Gyeonggi-do (KR); Na Ri Lee, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 66 days.

(21) Appl. No.: 13/347,217

(22) Filed: Jan. 10, 2012

(65) Prior Publication Data

US 2012/0180665 A1 Jul. 19, 2012

(30) Foreign Application Priority Data

Jan. 17, 2011 (KR) ..... 10-2011-0004582

(51) Int. Cl.
*B01D 46/00* (2006.01)

(52) U.S. Cl.
USPC ..... 96/414; 96/417; 96/418; 55/283; 55/299; 55/295; 55/429; 55/430; 55/432; 55/466; 55/471

(58) Field of Classification Search
USPC ..... 55/283, 289, 296, 385.2, 471, 290, 473, 55/352, 353, 354, 295, 297, 298, 299, 300, 55/DIG. 34, 472; 165/4–10, 95, 303, 165/DIG. 10, DIG. 11, DIG. 85; 62/157, 158, 62/259.1–263, 298–319; 134/21; 15/347, 15/352; 460/114
See application file for complete search history.

(56) References Cited

U.S. PATENT DOCUMENTS

| | | | | |
|---|---|---|---|---|
| 7,544,223 | B2 * | 6/2009 | Oda et al. | 55/289 |
| 8,007,553 | B2 * | 8/2011 | Cho et al. | 55/283 |
| 8,021,469 | B2 * | 9/2011 | Niezgoda et al. | 96/417 |
| 8,097,050 | B2 * | 1/2012 | Johnson et al. | 55/289 |
| 8,252,078 | B2 * | 8/2012 | Mun et al. | 55/283 |
| 8,282,695 | B2 * | 10/2012 | Shibuya et al. | 55/283 |
| 8,303,677 | B2 * | 11/2012 | Okada et al. | 55/289 |
| 8,439,996 | B2 * | 5/2013 | Sakashita et al. | 55/295 |
| 2002/0088208 | A1 * | 7/2002 | Lukac et al. | 55/289 |
| 2004/0000160 | A1 * | 1/2004 | Takashima et al. | 62/317 |
| 2007/0022720 | A1 * | 2/2007 | Guertin | 55/289 |
| 2009/0193769 | A1 * | 8/2009 | Mun et al. | 55/289 |
| 2009/0266382 | A1 * | 10/2009 | Hwang et al. | 134/21 |
| 2010/0107575 | A1 * | 5/2010 | Zhang et al. | 55/289 |
| 2010/0124958 | A1 * | 5/2010 | Memory | 460/114 |
| 2010/0155584 | A1 * | 6/2010 | Mack | 250/227.25 |
| 2010/0192772 | A1 * | 8/2010 | Poon | 96/26 |
| 2010/0294134 | A1 * | 11/2010 | Yokomizo et al. | 96/405 |
| 2011/0120066 | A1 * | 5/2011 | Sakashita | 55/282.2 |
| 2012/0151885 | A1 * | 6/2012 | Nishihata et al. | 55/289 |

FOREIGN PATENT DOCUMENTS

| | | |
|---|---|---|
| JP | 2010-216707 | 9/2010 |
| KR | 10-2008-0014591 | 2/2008 |
| KR | 10-2009-0128539 | 12/2009 |

* cited by examiner

*Primary Examiner* — Duane Smith
*Assistant Examiner* — Minh-Chau Pham
(74) *Attorney, Agent, or Firm* — Staas & Halsey LLP

(57) ABSTRACT

Disclosed herein is a ceiling embedded type air conditioner having a filter cleaning device to clean a filter. The filter cleaning device includes a cleaning unit to remove dust from the filter and a dust storage unit to store the dust removed by the cleaning unit. The filter may automatically and periodically be cleaned by the cleaning unit and the removed dust may be stored in the dust storage unit, which eliminates a need to separate and clean the filter.

24 Claims, 18 Drawing Sheets

CEILING EMBEDDED TYPE AIR CONDITIONER

CROSS-REFERENCE TO RELATED APPLICATIONS

This application claims the benefit of Korean Patent Applications No. 10-2011-0004582, filed on Jan. 17, 2011 in the Korean Intellectual Property Office, the disclosure of which is incorporated herein by reference.

BACKGROUND

1. Field

The following description disclosed herein relates to a ceiling embedded type air conditioner, which may be embedded in the ceiling to cool or heat an indoor space.

2. Description of the Related Art

Generally, a ceiling embedded type air conditioner is mounted in the ceiling of a room and serves to cool or heat indoor air.

A conventional ceiling embedded type air conditioner includes a main body frame in the form of a square box having an open bottom, a heat exchanger placed at an interior peripheral position of the main body frame, a blower fan placed at an interior center position of the main body frame, and a ceiling panel having a central suction opening and peripheral discharge opening through which air enters or exits. A suction grill is provided at the suction opening of the ceiling panel and a filter is provided inside the suction grill so as to capture dust or debris in air suctioned through the suction grill.

If the blower fan is rotated, air is suctioned through the suction grill into the main body frame to thereby pass through the filter via rotation of the blower fan, allowing dust or debris contained in the air to be captured and removed by the filter. The air having passed through the filter is delivered to the heat exchanger after passing through the blower fan. The air is heat-exchanged while passing through the heat exchanger and thereafter, is discharged through the discharge opening, thereby acting to heat or cool an indoor space.

SUMMARY

Therefore, it is an aspect of the present invention to provide a ceiling embedded type air conditioner in which it may be unnecessary for a user to directly clean a filter.

Additional aspects of the invention will be set forth in part in the description which follows and, in part, will be apparent from the description, or may be learned by practice of the invention.

In accordance with one aspect of the present invention, a ceiling embedded type air conditioner includes a main body frame having an open bottom, a ceiling panel defining the bottom of the main body frame and having an air suction opening and an air discharge opening, a filter placed inside the suction opening and serving to capture dust contained in air introduced through the suction opening, and a filter cleaning device to clean the filter, wherein the filter cleaning device includes a cleaning unit to remove dust from the filter and a dust storage unit to store dust removed by the cleaning unit, and wherein the dust storage unit includes a dust sump having an open top to store dust therein, a sump cover to cover the top of the dust sump, and a dust sensor to sense dust accumulated in the dust sump.

The dust sensor may include a photo sensor having a light emitting part and a light receiving part spaced apart from each other.

The dust storage unit may further include a pair of transparent caps spaced apart from each other, in which the light emitting part and the light receiving part are respectively accommodated.

The transparent caps may protrude into the dust sump through sensor holes of the sump cover.

The air conditioner may further include a dust discharge guide unit installed to the dust sump to allow dust to be discharged from the dust sump.

The dust discharge guide unit may include a dust discharge guide having a dust discharge hole, a support bracket installed to the dust sump so as to vertically movably support the dust discharge guide via an elastic discharge guide member, and an opening/closing member to open or close the dust discharge hole according to vertical movement of the dust discharge guide.

The opening/closing member may include an opening/closing portion configured to open or close the dust discharge hole, a pair of hinges provided at opposite sides of the opening/closing portion and each having a hinge pin rotatably coupled to the dust discharge guide, and a cam piece adjacent to the hinge pin of the corresponding hinge, and the support bracket may include a rotating guide piece adapted to support the cam piece upon upward movement of the dust discharge guide, allowing the opening/closing member to be rotated.

The dust sump may include a dust discharge port having a center through-hole, to which the dust discharge guide is vertically movably connected, and the dust discharge guide may include a domed portion having an arc-shaped cross section to protrude downward beyond the through-hole, and a retainer portion provided around the domed portion so as to be caught by a portion of the dust discharge port adjacent to the through-hole.

The dust sump may include an air suction hole through which air may be introduced into the dust sump, and the dust storage unit may contain an air guide to guide the air introduced through the air suction hole to an inner bottom surface of the dust sump.

The air guide may include a filter portion placed inside the air suction hole to cover the air suction hole and an air guide portion inclined downward from an upper end of the filter portion into the dust sump.

The cleaning unit may include a brush to remove dust from the filter via rotation thereof and a transfer auger to transfer dust removed by the brush into the dust storage unit.

In accordance with another aspect of the invention, a ceiling embedded type air conditioner includes a main body frame having an open bottom, a ceiling panel defining the bottom of the main body frame and having an air suction opening and an air discharge opening, a filter placed inside the suction opening and serving to capture dust of air introduced through the suction opening, and a filter cleaning device to clean the filter, wherein the filter cleaning device includes a cleaning unit to remove dust from the filter and a dust storage unit to store dust removed by the cleaning unit, and wherein the cleaning unit includes a brush to remove dust from the filter via rotation thereof and a transfer auger to transfer dust removed by the brush into the dust storage unit.

The air conditioner may further include a brush cleaner installed to be movable toward the brush so as to remove dust from the brush.

The air conditioner may further include an elastic cleaner support member to movably support the brush cleaner toward the brush.

The brush may include brush files to remove dust from the filter, and the brush cleaner may include cleaner files to remove dust from the brush files.

The cleaner files may tilt downward, and the brush files may tilt in a circumferential direction to remove dust from the filter or to allow the cleaner files to remove dust from the brush files according to a rotating direction of the brush.

The transfer auger may include a shaftless auger.

In accordance with another aspect of the invention, a ceiling embedded type air conditioner includes a main body frame having an open bottom, a ceiling panel defining the bottom of the main body frame and having an air suction opening and an air discharge opening, a filter placed inside the suction opening and serving to capture dust of air introduced through the suction opening, and a filter cleaning device to clean the filter, wherein the filter cleaning device includes a cleaning unit to remove dust from the filter and a dust storage unit to store dust removed by the cleaning unit, and wherein the dust storage unit includes a dust sump to store dust therein, the dust sump having an air suction hole through which air may be introduced into the dust sump, and an air guide to guide the air introduced through the air suction hole to an inner bottom surface of the dust sump.

In accordance with a further aspect of the invention, a filter cleaning method of a ceiling embedded type air conditioner includes rotating a brush in a first direction by a first angle to clean a filter, rotating the brush in the first direction by a second angle to allow brush files of the brush used to clean the filter to pass through a brush cleaner, rotating the brush in a second direction opposite to the first direction by a third angle to allow the brush files to be cleaned by the brush cleaner, and rotating the brush in the first direction by a fourth angle less than the third angle to allow cleaner files of the brush cleaner to be cleaned by the brush.

The rotating the brush in the second direction opposite to the first direction by the third angle to allow all the brush files of the brush to be cleaned by the brush cleaner and the rotating the brush in the first direction by the fourth angle less than the third angle to allow the cleaner files of the brush cleaner to be cleaned by the brush may be alternately repeated.

The method may further include judging, via a positional sensor, whether or not the brush is at an initial position, prior to the rotating the brush by the first angle, and if the brush is not at the initial position, rotating the brush until the brush reaches the initial position.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
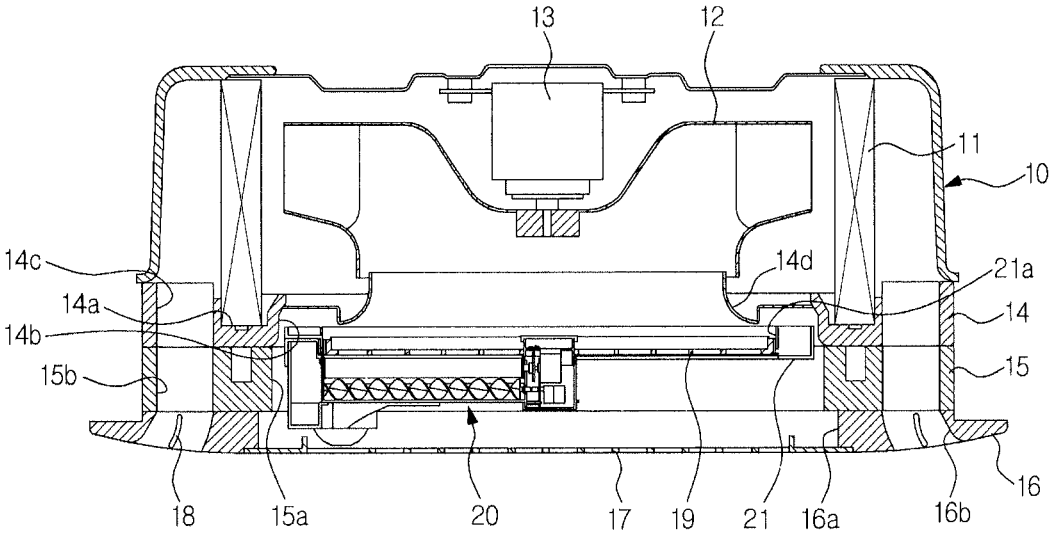
FIG. 1 is a cross sectional view of a ceiling embedded type air conditioner according to an exemplary embodiment.

Reference will now be made in detail to a ceiling embedded type air conditioner according to the embodiments disclosed herein, examples of which are illustrated in the accompanying drawings, wherein like reference numerals refer to like elements throughout.

The ceiling embedded type air conditioner according to the exemplary embodiment, as illustrated in FIG. 1, includes a main body frame 10, which takes the form of a substantially square box having an open bottom to accommodate components of the air conditioner therein, a blower fan 12, which may be placed at an interior center position of the main body frame 10 to enable circulation of air, a heat exchanger 11, which has a square annular form and may be placed around the blower fan 12, a drain pan 14, which has a square annular form to correspond to the heat exchanger 11 and may be located under the heat exchanger 11 so as to receive and collect condensed water from the heat exchanger 11, a ceiling panel 16, which defines the bottom of the air conditioner and has a central suction opening 16*a* for air suction and a peripheral discharge opening for air discharge, a filter 19, which has a disc form and may be located inside the suction opening 16*a* so as to remove dust or debris from air suctioned through the suction opening 16*a*, and a filter support member 15, which has a square annular form and may be placed between the ceiling panel 16 and the drain pan 14 so as to support the filter 19 as well as a filter cleaning device 20 that will be described hereinafter.

A fan motor 13 to drive the blower fan 12 may be secured to the center of an inner top surface of the main body frame 10. The blower fan 12 may be a centrifugal fan that axially suctions air and radially discharges the air. As such, the blower fan 12 acts to suction air through the suction opening 16*a* of the ceiling panel 16 and discharge the air toward the heat exchanger 11 placed at a radial outer position thereof.

The drain pan 14 may be located in a lower region of the main body frame 10 and may be configured to receive a lower end of the heat exchanger 11. The drain pan 14 has a condensed water receiving groove 14*a* defined in a bottom surface thereof, a first suction guide passage 14*b* defined by an inner surface thereof to guide the air having passed through the suction opening 16*a* into the blower fan 12, and a first discharge guide passage 14*c* located at the outer side of the condensed water receiving groove 14*a* to guide the air discharged from the blower fan 12 to the discharge opening 16*b*. Additionally, a guide duct 14*d* may be provided in the first suction guide passage 14*b* so as to guide the air toward the center of the blower fan 12.

The filter support member 15 has a second suction guide passage 15*a* and a second discharge guide passage 15*b*, which are collinearly connected respectively to the first suction guide passage 14*b* and the first discharge guide passage 14*c* of the drain pan 14. A filter bracket 21 having a circular filter aperture 21*a* in which the filter 19 is rotatably inserted may be placed inside the second suction guide passage 15*a*.

Figure 2:
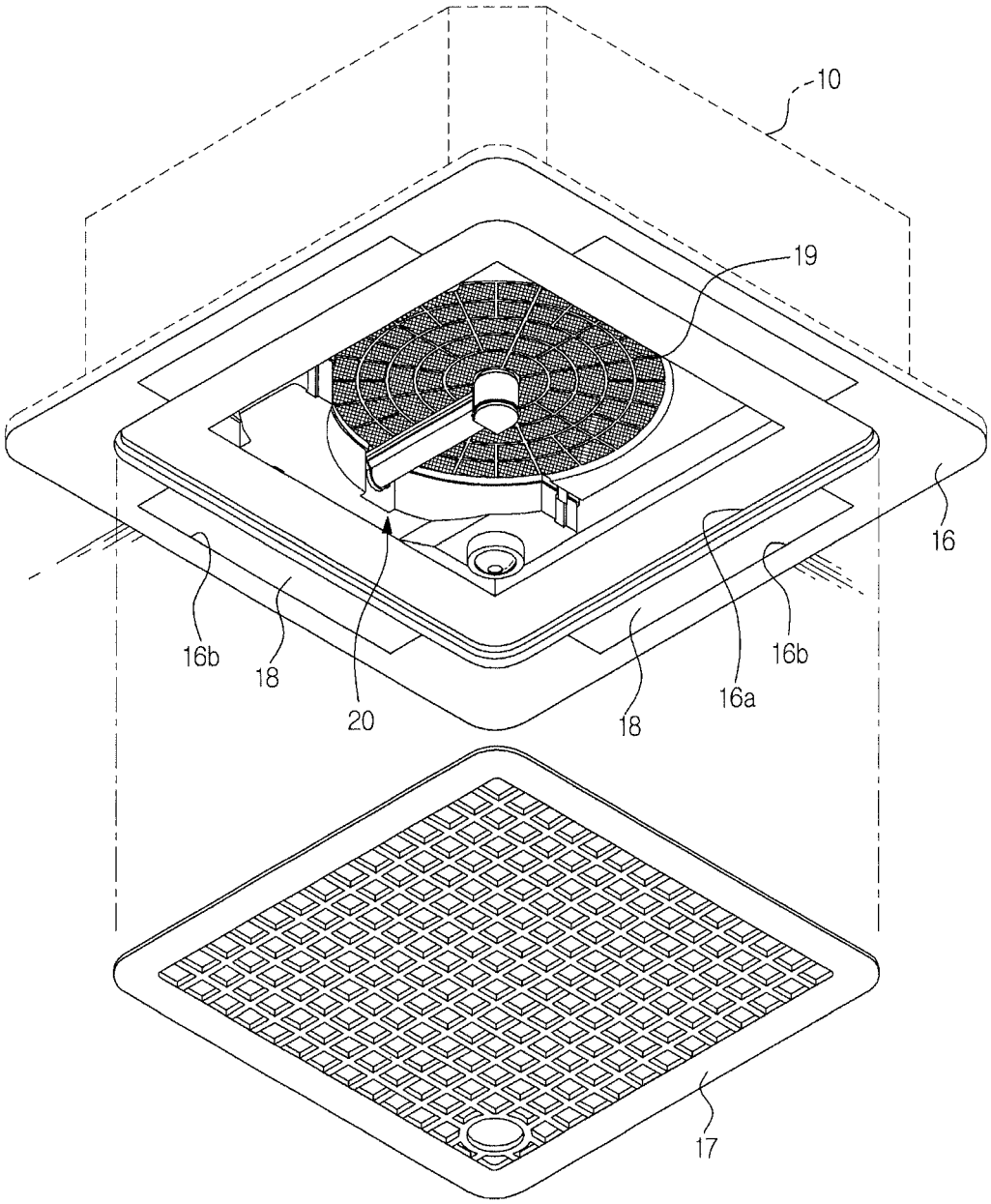
FIG. 2 is a perspective view illustrating installation of a filter cleaning device with respect to the ceiling embedded type air conditioner according to the exemplary embodiment.

The ceiling panel 16, as illustrated in FIG. 2, has a square panel form and the above-described suction opening 16*a* may be a central square opening of the ceiling panel 16. The above-described discharge opening 16*b* includes four discharge openings 16*b* arranged along the rim of the ceiling panel 16 to correspond to four sides of the ceiling panel 16. A suction grill 17 may be fitted into the suction opening 16*a* of the ceiling panel 16 to cover the suction opening 16*a* while allowing passage of air. Each discharge opening 16*b* of the ceiling panel 16 may be provided with a guide blade 18 to control the direction of the air discharged through the discharge opening 16*b*.

In the ceiling embedded type air conditioner as described above, dust accumulates on the filter 19 over time and prevents air from passing through the filter 19, which may deteriorate performance of the ceiling embedded type air conditioner. This results in a need for periodic cleaning of the filter 19.

Figure 3:
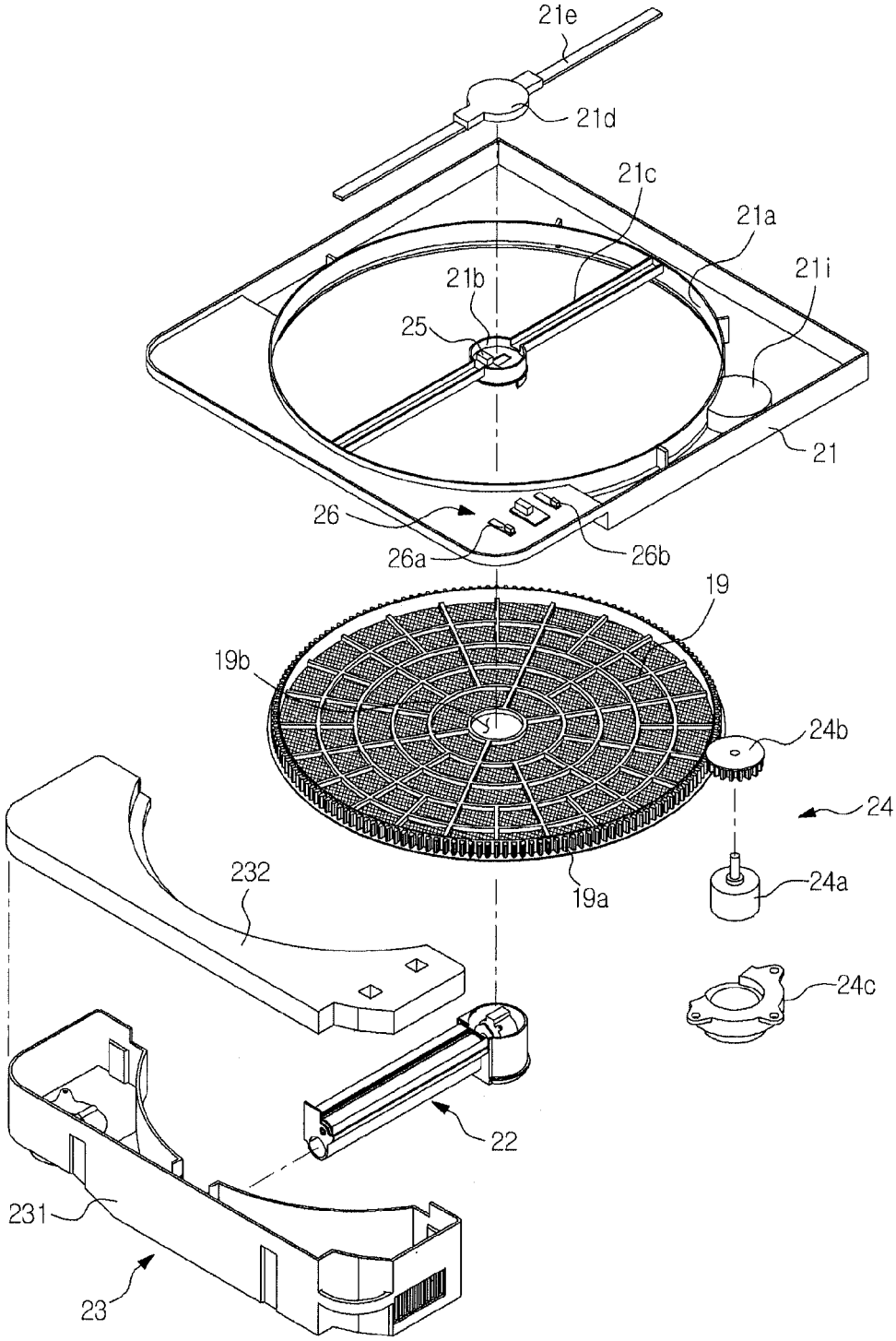
FIG. 3 is an exploded perspective view of the filter cleaning device provided in the ceiling embedded type air conditioner according to the exemplary embodiment.
Figure 4:
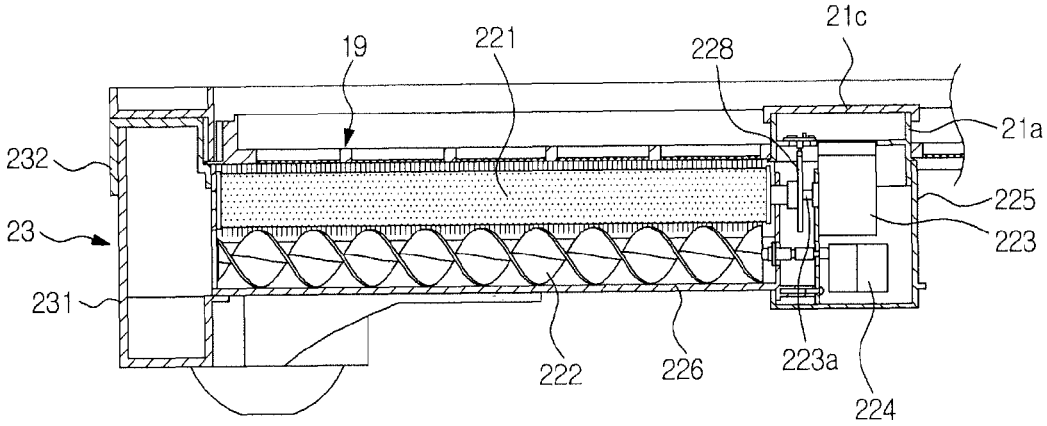
FIG. 4 is a cross sectional view of the filter cleaning device provided in the ceiling embedded type air conditioner according to the exemplary embodiment.

The ceiling embedded type air conditioner according to the present embodiment ensures automated cleaning of the filter 19. To this end, the ceiling embedded type air conditioner, as illustrated in FIGS. 3 and 4, includes filter cleaning devices 22 and 23 to clean the filter 19, and a filter drive mechanism 24 to rotate the filter 19 such that a region to be cleaned by the filter cleaning devices 22 and 23 may vary.

The filter drive mechanism 24 may be mounted in the filter bracket 21 and includes a filter drive motor 24*a* to generate rotational power and a gear 24*b* to be rotated by the filter drive motor 24*a*. The filter 19 may be provided at a distal circumferential edge thereof with teeth 19*a*. The gear 24*b* may be engaged with the teeth 19*a* of the filter 19 to transmit rotational power to the teeth 19*a* so as to enable rotation of the filter 19.

The filter bracket 21 has a recessed mount 21*i* for the filter drive mechanism 24. Additionally, a drive mechanism case 24*c* may be installed to the filter bracket 21 and assists in fixedly mounting the filter drive mechanism 24 to the filter bracket 21.

The filter bracket 21 includes a hub 21*b* to allow rotatable installation of the filter 19 and a plurality of legs 21*c* integrally extending from the hub 21*b* so as to be connected to the filter bracket 21. The hub 21*b* may be positioned at the center of the filter aperture 21*a* via the legs 21*c*. The filter 19 has a central hub aperture 19*b* to allow the filter 19 to be rotatably installed to the hub 21*b*. The hub 21*b* of the filter bracket 21 may be provided with a positional sensor 25 that will be described hereinafter. Thus, to protect the positional sensor 25 from dust, etc., a hub cover 21*d* may be coupled with the hub 21*b*. A reinforcing bar 21*e* may be provided to enhance rigidity of both the hub 21*b* and the legs 21*c*.

The filter cleaning devices 22 and 23 include a cleaning unit 22 to remove dust from the filter 19 and a dust storage unit 23 in which dust removed by the cleaning unit 22 may be stored.

Figure 5:
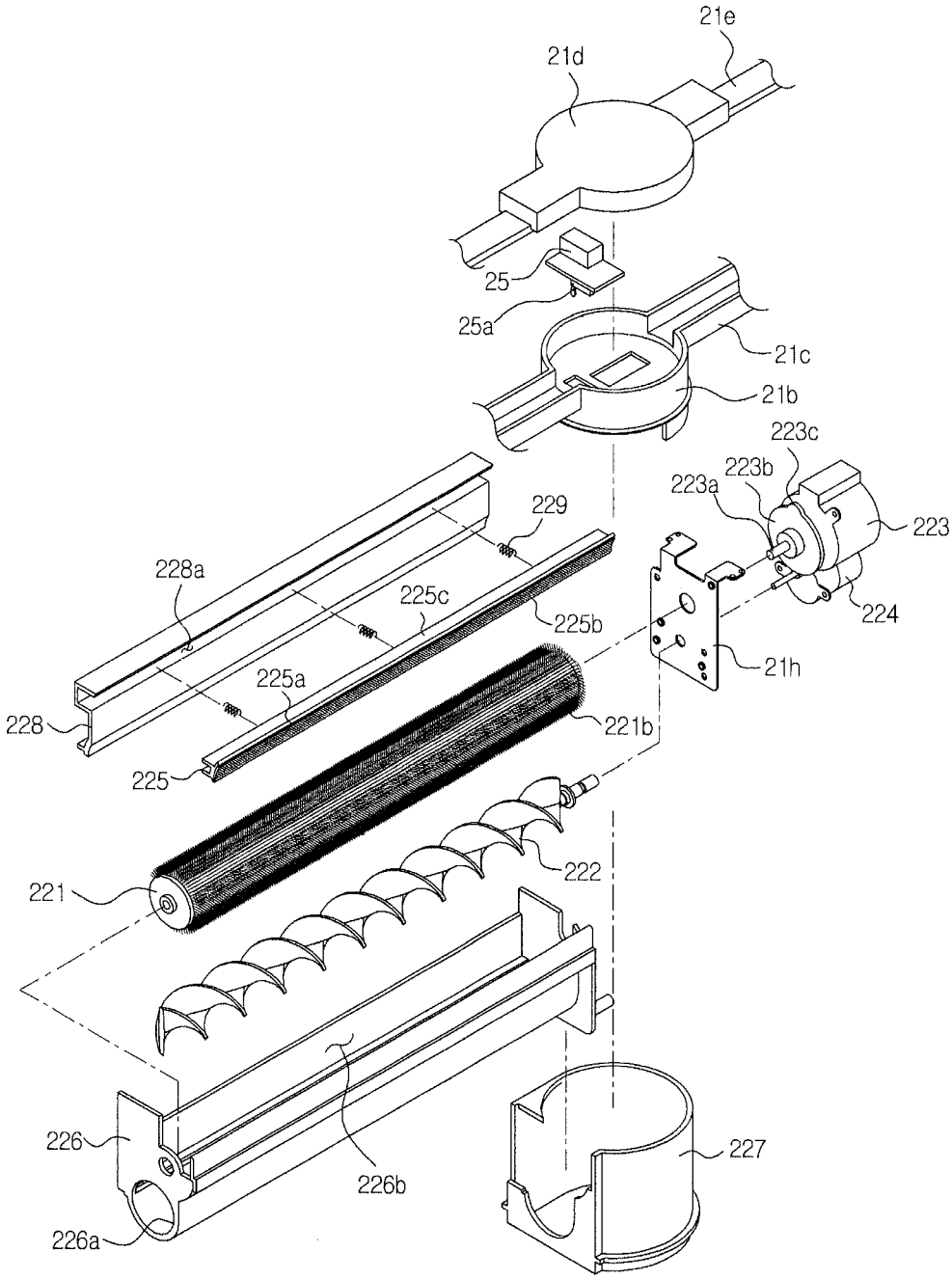
FIG. 5 is an exploded perspective view of a cleaning unit provided in the ceiling embedded type air conditioner according to the exemplary embodiment.
Figure 6:
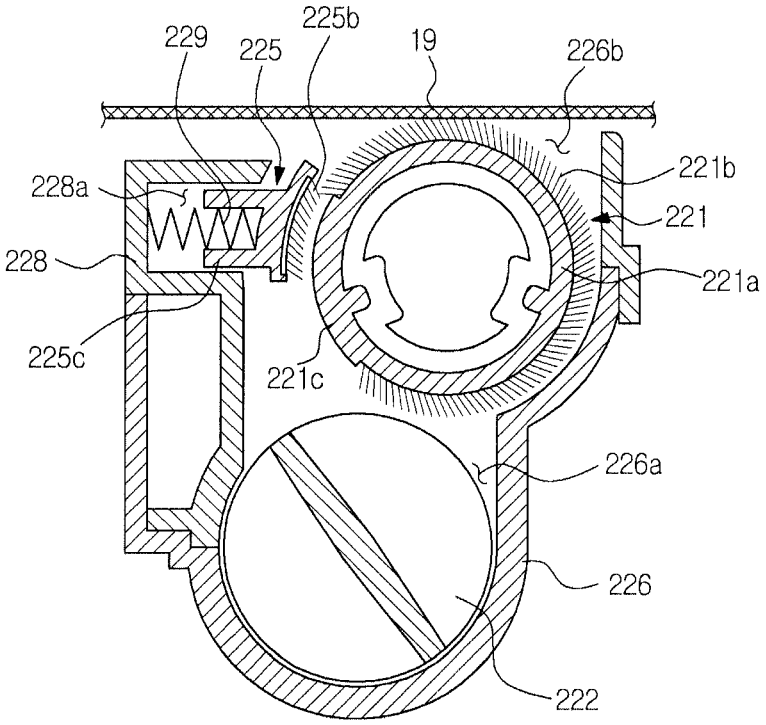
FIG. 6 is a cross sectional view of the cleaning unit provided in the ceiling embedded type air conditioner according to the exemplary embodiment.

The cleaning unit 22, as illustrated in FIGS. 5 and 6, includes a brush 221, a transfer auger 222, a brush drive motor 223 to rotate the brush 221, an auger drive motor 224 to rotate the transfer auger 222, and a brush cleaner 225. The brush 221 extends lengthwise in a radial direction of the filter 19 and serves to sweep dust away from a lower surface of the filter 19 while rotating in contact with the lower surface of the filter 19. The transfer auger 222 also extends lengthwise in a radial direction of the filter 19 and may be located under the brush 221 so as to guide the dust removed from the filter 19 by the brush 221 into the dust storage unit 23. The brush cleaner 225 to clean the brush 221 may be arranged next to the brush 221 and may be approximately equal or equal in length to the brush 221. As the dust removed from the filter may be adhered to the brush 221, the brush cleaner 225 serves to remove the dust from the brush 221 for cleaning of the brush 221.

Additionally, the cleaning unit 22 includes a cleaning unit case 226 in which the brush 221 and the transfer auger 222 are accommodated, the cleaning unit case 226 has an open top to expose the top of the brush 221, a drive case 227 in which the brush drive motor 223 and the auger drive motor 224 are accommodated, and a cleaner guide 228 into which the brush cleaner 225 may be movably inserted, the cleaner guide 228 being coupled to the cleaning unit case 226. In this configuration, the brush drive motor 223 and the auger drive motor 224 are respectively secured to a drive bracket 21*h* that may be in turn secured to the hub 21*b* as described below. That is, the brush drive motor 223 and the auger drive motor 224 are accommodated within the drive case 227 while being secured to the drive bracket 21*h*.

The brush 221 includes a cylindrical base 221*a* and a plurality brush files 221*b* arranged on the circumference of the base 221*a* to come into frictional contact with the filter 19. The base 221*a* includes a blank portion 221*c* in which the brush files 221*b* are not arranged. As the brush cleaner 225 removes dust from some of the brush files 221*b*, the dust removed from the brush files 221*b* may be partially reattached to neighboring ones of the brush files 221*b*. The blank portion 221*c* serves to prevent reattachment of the dust.

The brush cleaner 225 includes a cleaning zone 225*a* having a curvature corresponding to the circumference of the brush 221 in which a plurality of cleaner files 225*b* may be arranged, and a movement guide structure 225*c* disposed at the rear of the cleaning zone 225*a* to allow the brush cleaner 225 to be movably inserted into the cleaner guide 228 as described below.

The above-described brush files 221*b* tilt counterclockwise from the brush 221, whereas the cleaner files 225*b* tilt downward. This arrangement may allow cleaning of the filter 19 by the brush 221 and cleaning of the brush 221 by the brush cleaner 225 to be selectively implemented depending on a rotating direction of the brush 221.

As a result of the brush cleaner 225 being located at the left side of the brush 221 and the brush files 221*b* tilting counterclockwise as illustrated in the drawings, the brush 221 may perform cleaning of the filter 19 when rotated counterclockwise and allow the dust to be removed and fall from the brush files 221*b* by the cleaner files 225*b* of the brush cleaner 225 when rotated clockwise. In this case, counterclockwise rotation of the brush 221 also causes the brush cleaner 225 to be cleaned as the dust adhered to the brush cleaner 225 may be removed by the brush 221.

Figure 7:
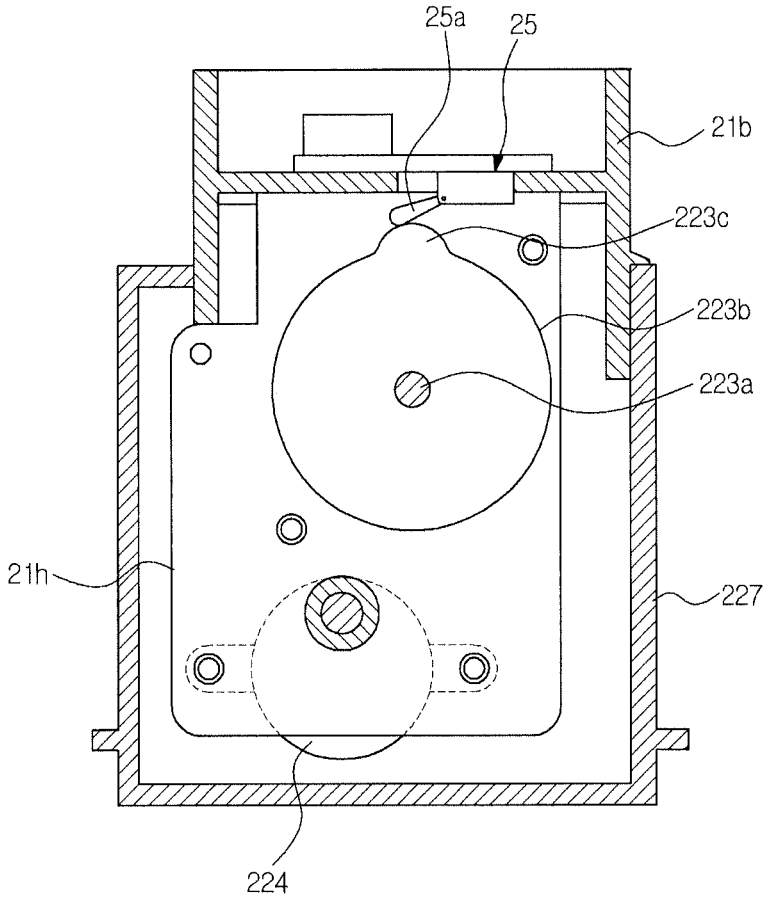
FIG. 7 is a cross sectional view illustrating a cam and a positional sensor included in the cleaning unit of the ceiling embedded type air conditioner according to the exemplary embodiment.

Referring to FIG. 7, to rotate the brush 221 to a reference position thereof at the beginning of operation of the cleaning unit 22, a cam 223*b* may be fitted onto a rotating shaft 223*a* of the brush drive motor 223. The positional sensor 25 installed to the hub 21*b* serves to sense the reference position of the brush 221 via the cam 223*b*.

The cam 223*b* has a radially outwardly protruding position sensing cam portion 223*c*. The positional sensor 25 has a sensing piece 25*a* to be pressurized and rotated by the position sensing cam portion 223*c*. As such, if the rotating shaft 223*a* is rotated to rotate the brush 221, the cam 223*b* may be rotated along with the brush 221, acting to rotate the sensing piece 25*a* and allowing the sensor 225 to confirm the reference position of the brush 221.

Referring again to FIG. 5, the transfer auger 222 has a helical form to guide dust accumulated in the cleaning unit case 226 from one side to the other side via rotation thereof. The transfer auger 222 may be a shaftless auger and prevents a lump of fibrous dust from becoming tangled in and accumulated on an auger shaft.

The cleaning unit case 226 contains a lower auger accommodating region 226*a* in which the transfer auger 222 may be accommodated and an upper brush accommodating region 226*b* in which the brush 221 may be accommodated. The drive case 227 has a fixed location underneath the hub 21*b*, and one end of the cleaning unit case 226 may be secured to the drive bracket 21*h* within the drive case 227. Since the other end of the cleaning unit case 226 may be secured to the dust storage unit 23, it will be assumed that the cleaning unit case 226 extends lengthwise in a radial direction of the filter 19 via the drive bracket 21*h* and the dust storage unit 23.

The above-described cam 223*b* may be accommodated in the drive case 227, and the sensing piece 25*a* of the above-described positional sensor 25 installed to the hub 21*b* penetrates the hub 21*b* so as to protrude into the drive case 227. Thus, the position sensing cam portion 223*c* of the cam 223*b* may be sensed by the sensing piece 25*a* during rotation of the cam 223*b*.

The cleaner guide 228 has a movement guide groove 228*a* into which the brush cleaner 225 may be inserted to be movable toward the brush 221. Specifically, the movement guide structure 225*c* may be seated in the movement guide groove 228*a* of the cleaner guide 228 with a plurality of elastic support members 229 interposed therebetween. The elastic support members 229 act to elastically push the brush cleaner 225 toward the brush 221. The cleaner guide 228 may be located at one side of the cleaning unit case 226 to thereby define a sidewall of the auger accommodating region 226*a* and the brush accommodating region 226*b*.

Figure 8:
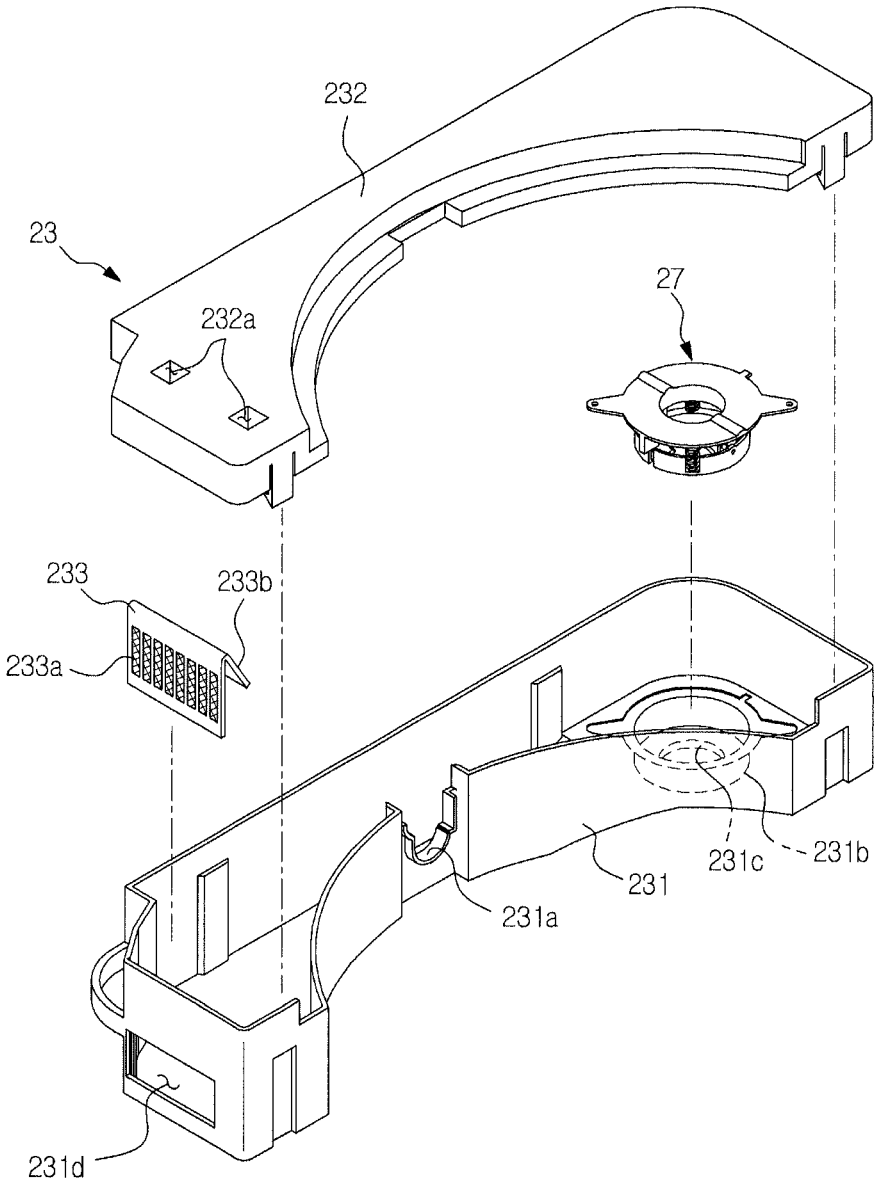
FIG. 8 is an exploded perspective view illustrating a dust tray provided in the ceiling embedded type air conditioner according to the exemplary embodiment.

The dust storage unit 23, as illustrated in FIG. 8, includes a dust sump 231 having an open top to store the dust directed by the transfer auger 222 therethrough and a sump cover 232 to cover the open top of the dust sump 231. The dust sump 231 has a dust entrance 231*a* perforated in a sidewall thereof, to which the above-described cleaning unit case 226 may be connected such that the dust directed thereto by the transfer auger 222 of the cleaning unit 22 is introduced into the dust sump 231 through the dust entrance 231*a*. A dust discharge port 231*b* may be formed in one end of the bottom of the dust sump 231 so that the dust in the dust sump 231 may be removed by a vacuum cleaner. An end wall of the dust sump 231 opposite to the dust discharge port 231*b* may be provided with an air suction hole 231*d* so that air may be suctioned into the dust sump 231 while the vacuum cleaner is suctioning the dust from the dust sump 231.

With transfer of the dust using the transfer auger 222 as described above, the dust introduced through the dust entrance 231*a* by the transfer auger 222 may be compressed between the transfer auger 222 and an inner surface of the dust sump 231 opposite to the dust entrance 231*a* and thereafter, may be moved to opposite ends of the dust sump 231. That is, as a result of compressing the dust via the transfer auger 222, a greater amount of dust may be stored in the dust sump 231.

Figure 9:
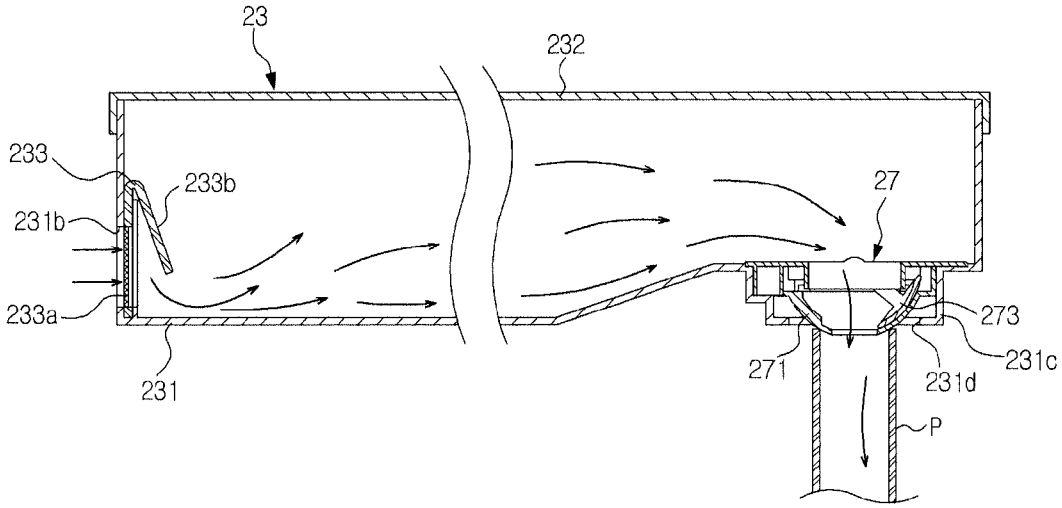
FIG. 9 is a cross sectional view illustrating the flow of air within the dust tray provided in the ceiling embedded type air conditioner according to the exemplary embodiment.

An air guide 233 may be installed in the dust sump 231 inside the air suction hole 231*d* to guide air introduced through the air suction hole 231*d* to a bottom surface of the dust sump 231, which may assist the vacuum cleaner in efficiently suctioning the dust accumulated on the bottom surface of the dust sump 231. In the present embodiment, the air guide 233 includes a filter portion 233*a*, which may be located inside the air suction hole 231*d* so as to cover the air suction hole 231*d*, and an air guide portion 233*b*, which may be inclined inward and downward from an upper end of the filter portion 233*a*. As illustrated in FIG. 9, the air suctioned through the air suction hole 231*d* may be guided downward by the air guide 233 after passing through the filter portion 233*a*, thereby serving to push the dust accumulated on the bottom surface of the dust sump 231 up, which may assist the vacuum cleaner in efficiently suctioning the dust accumulated in the dust sump 231.

Figure 10:
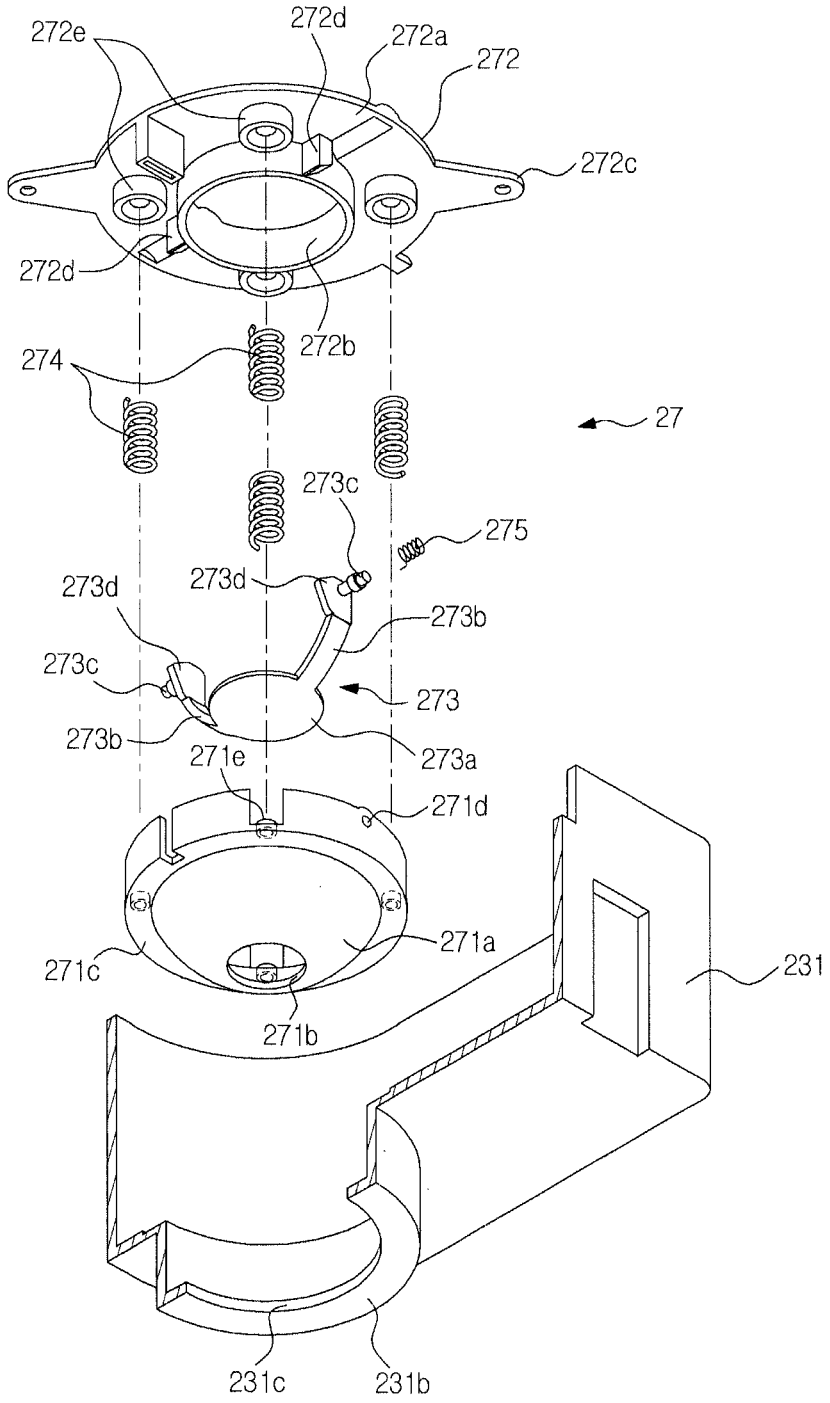
FIG. 10 is an exploded perspective view of a dust discharge guide unit provided in the ceiling embedded type air conditioner according to the exemplary embodiment.
Figure 11:
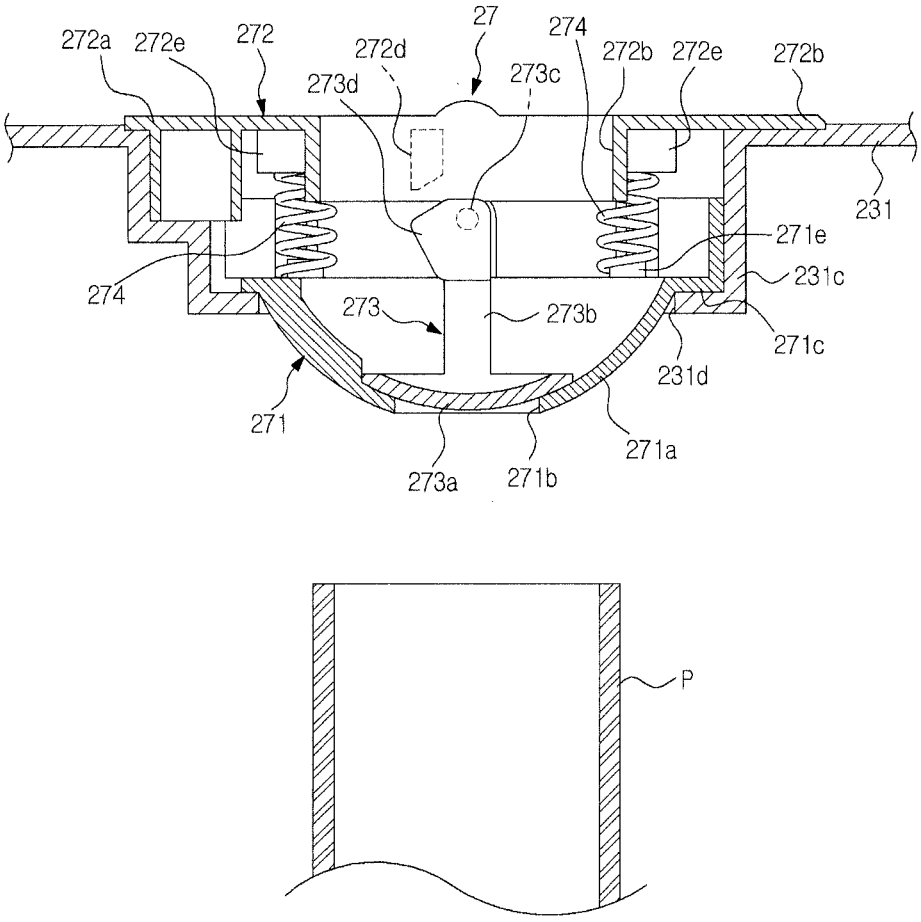
FIGS. 11 and 12 are cross sectional views illustrating operation of the dust discharge guide unit provided in the ceiling embedded type air conditioner according to the exemplary embodiment.

A dust discharge guide unit 27 may be connected to the dust discharge port 231*b* to mediate discharge of dust via the vacuum cleaner. The dust discharge guide unit 27, as illustrated in FIGS. 10 and 11, includes a dust discharge guide 271 having a dust discharge hole 271*b*, a support bracket 272 attached to the dust sump 231 so as to support the dust discharge guide 271 in a vertically movable manner, and an opening/closing member 273 to open or close the dust discharge hole 271*b* according to vertical movement of the dust discharge guide 271. The dust discharge guide 271 may be vertically movably connected to the dust discharge port 231*b* by use of a plurality of elastic discharge guide members 274 in the form of coil springs.

The dust discharge guide 271 includes a domed portion 271*a*, which may be centrally provided with the dust discharge hole 271*b* and has an arc-shaped cross section to easily guide dust to the dust discharge hole 271*b*. The domed portion 271*a* of the dust discharge guide 271 protrudes downward through a through-hole 231*c* of the dust discharge port 231*b*. Additionally, the dust discharge guide 271 includes a retainer portion 271*c* extending outward from the domed portion 271*a* so as to be caught by an inner circumferential portion of the dust discharge port 231*b* adjacent to the through-hole 231*c*, a pair of hinge pin holes 271*d*, to which both ends of the above-described opening/closing member are rotatably fitted, and a plurality of first bosses 271*e* arranged on an upper surface of the retainer portion 271*c* to support lower ends of the respective elastic discharge guide members 274.

The support bracket 272 includes an annular support portion 272*a* to support the dust discharge guide 271 via the elastic discharge guide members 274, and fixing portions 272*c* extending outward from the support portion 272*a* so as to be secured to the bottom surface of the dust sump 231. The support portion 272*a* has a center dust discharge aperture 272*b*, through which dust may be guided to the dust discharge hole 271*b*, and a plurality of second bosses 272*e* may be arranged on a lower surface of the annular support portion 272*a* to support upper ends of the respective elastic discharge guide members 274. Additionally, rotating guide pieces 272*d* protrude downward from the lower surface of the support portion 272*a* to guide rotation of the opening/closing member 273 according to upward movement of the discharge guide 271.

The opening/closing member 273 includes an opening/closing portion 273*a* to open or close the dust discharge hole 271*b* via rotation thereof, and a pair of hinges 273*b* extending upward from opposite sides of the opening/closing portion 273*a*. The hinges 273*b* are respectively provided at upper ends thereof with hinge pins 273*c* which are rotatably inserted into the hinge pin holes 271*d* of the dust discharge guide 271. The hinges 273*b* are further provided with a pair of rotating cam pieces 273*d* adjacent to the hinge pins 273*c*. The rotating cam pieces 273*d* interact with the above-described rotating guide pieces 272*d* as the dust discharge guide 271 may be moved upward, causing rotation of the opening/closing member 273. A return spring 275 in the form of a torsion spring may be fitted on each hinge pin 273*c*.

Figure 12:
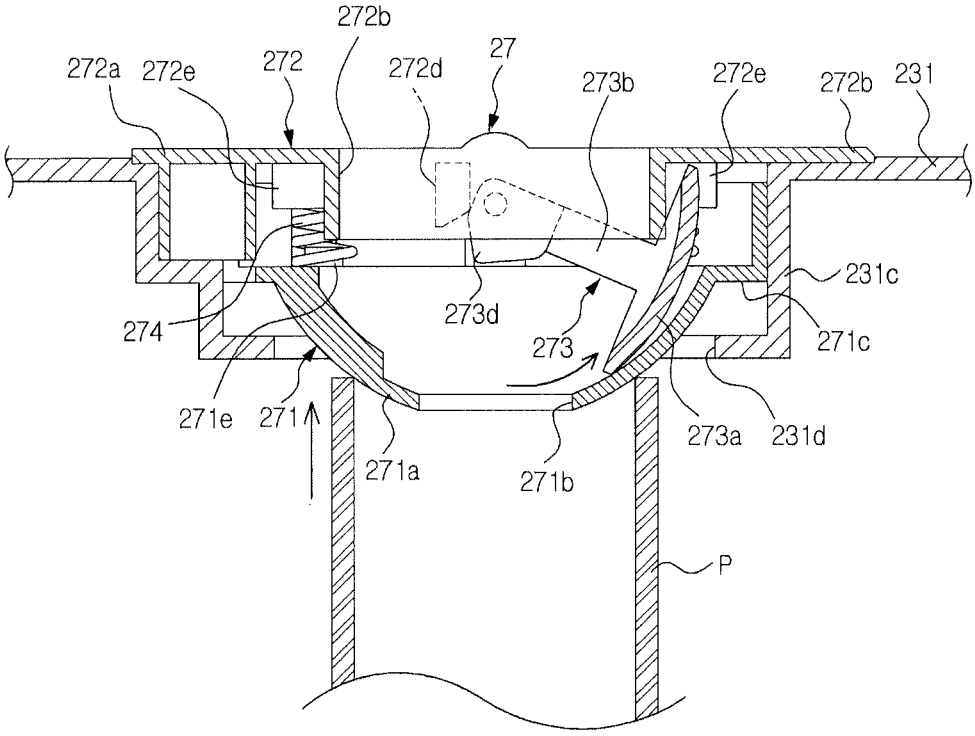

Accordingly, if force is applied to the domed portion 271*a* of the dust discharge guide 271 via a pipe P of the vacuum cleaner in a state in which the dust discharge hole 271*b* is closed by the opening/closing portion 273*a* as illustrated in FIG. 12, the dust discharge guide 271 may be moved upward via deformation of the elastic discharge guide members 274. With movement of the dust discharge guide 271, the rotating cam pieces 273*d* of the opening/closing member 273 are supported by the rotating guide pieces 272*d*, which causes the opening/closing member 273 to rotate about the hinge pins 273*c*. As the opening/closing member 273 is rotated, the dust discharge hole 271*b* closed by the opening/closing portion 273*a* is opened, whereby dust in the dust sump 231 may be suctioned into the pipe P of the vacuum cleaner through the dust discharge hole 271*b*.

If the pipe P of the vacuum cleaner is separated from the domed portion 271*a* after removal of the dust from the dust sump 231 as illustrated in FIG. 11, the dust discharge guide 271 may be moved downward by restoration of the elastic discharge guide members 274 and the opening/closing member 273 may be rotated to return to an original position thereof by restoration of the return springs 275, whereby the dust discharge hole 271 is again closed by the opening/closing member 273*a*.

Figure 13:
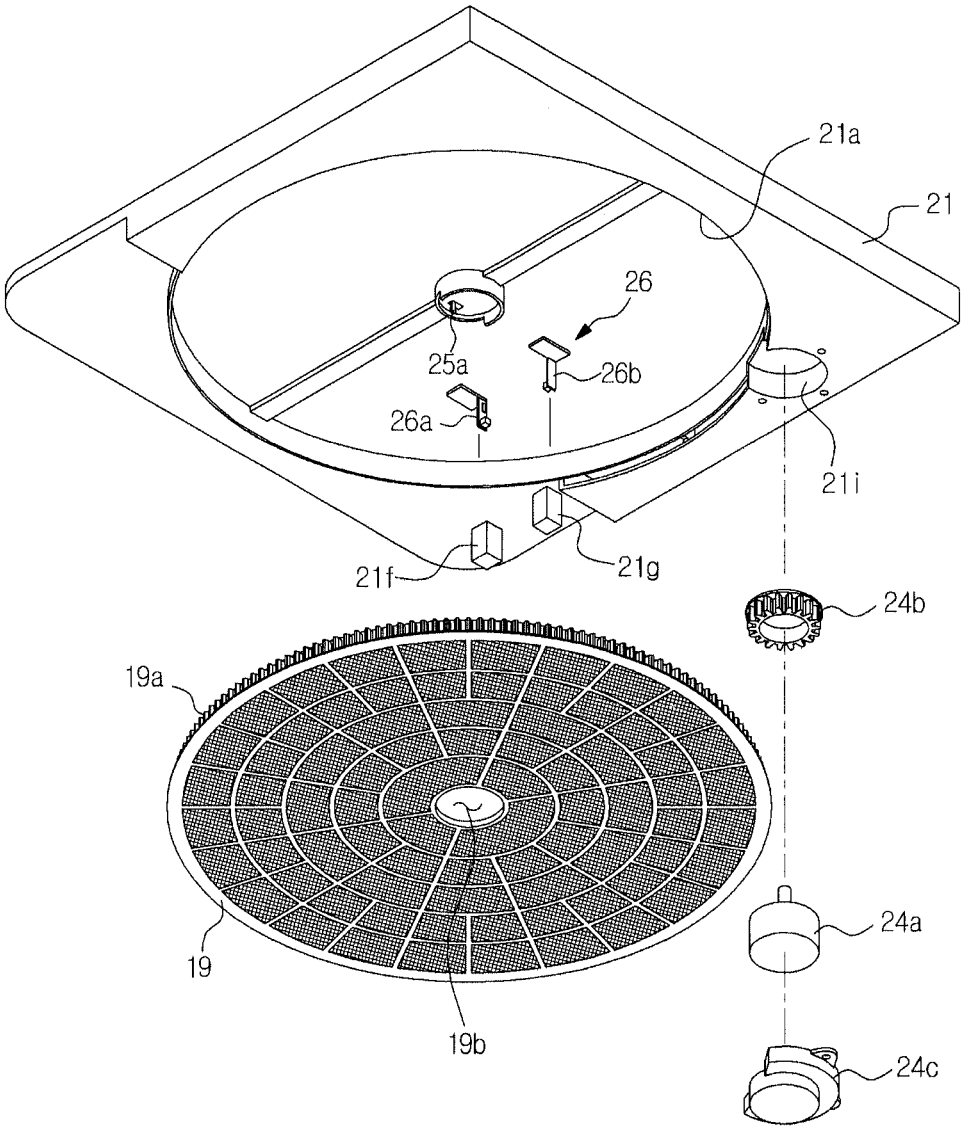
FIG. 13 is an exploded perspective view illustrating installation of a dust sensor with respect to the ceiling embedded type air conditioner according to the exemplary embodiment.

Referring to FIG. 13, the ceiling embedded type air conditioner includes a dust sensor 26 to indicate when the dust sump 231 shall be cleaned. The dust sensor 26 may be a photo sensor having a light emitting part 26*a* and a light receiving part 26*b* and may be installed to the filter bracket 21. A pair of transparent caps 21*f* and 21*g* may be arranged at the filter bracket 21 so as to protrude downward from a lower surface of the filter bracket 21. The light emitting part 26*a* and the light receiving part 26*b* are respectively accommodated in the two transparent caps 21*f* and 21*g*. Referring again to FIG. 8, the sump cover 232 has sensor holes 232*a* such that the transparent caps 21*f* and 21*g* and the light emitting and receiving parts 26*a* and 26*b* accommodated in the caps 21*f* and 21*g* protrude into the dust sump 231 through the sump cover 232.

If the dust sump 231 is filled with dust to the extent that the dust fills the space between the two transparent caps 21*f* and 21*g* in which the light emitting part 26*a* and the light receiving element 26*b* are accommodated, light from the light emitting part 26*a* does not reach the light receiving part 26*b*, which indicates that the dust sump 231 is full of dust.

In the ceiling embedded type air conditioner having the above-described configuration, hereinafter, a cleaning operation of the filter 19 by the brush 221 and a cleaning operation of the brush 221 by the brush cleaner 225 will be described with reference to the drawings.

Figure 14:
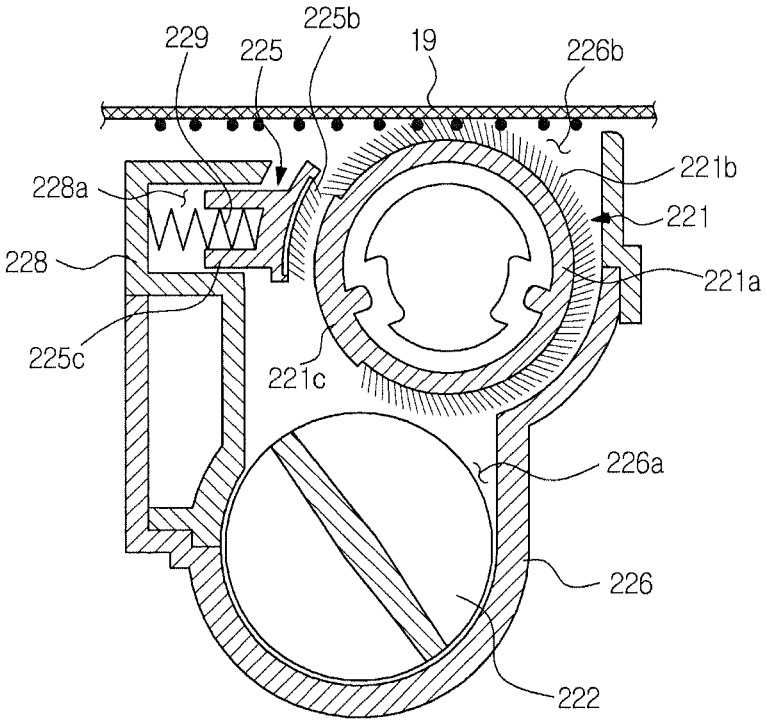
FIGS. 14 to 18 are cross sectional views illustrating an operation sequence of the cleaning unit provided in the ceiling embedded type air conditioner according to the exemplary embodiment.

If it is determined, based on a position of the brush 221 sensed by the positional sensor 25, that the sensing piece 25*a* is not pressurized by the position sensing cam portion 223*c*, as illustrated in FIG. 14, the brush 221 may be rotated by the brush drive motor 223 until the sensing piece 25*a* senses the position sensing cam portion 223*c*, thereby reaching a reference position thereof.

Figure 15:
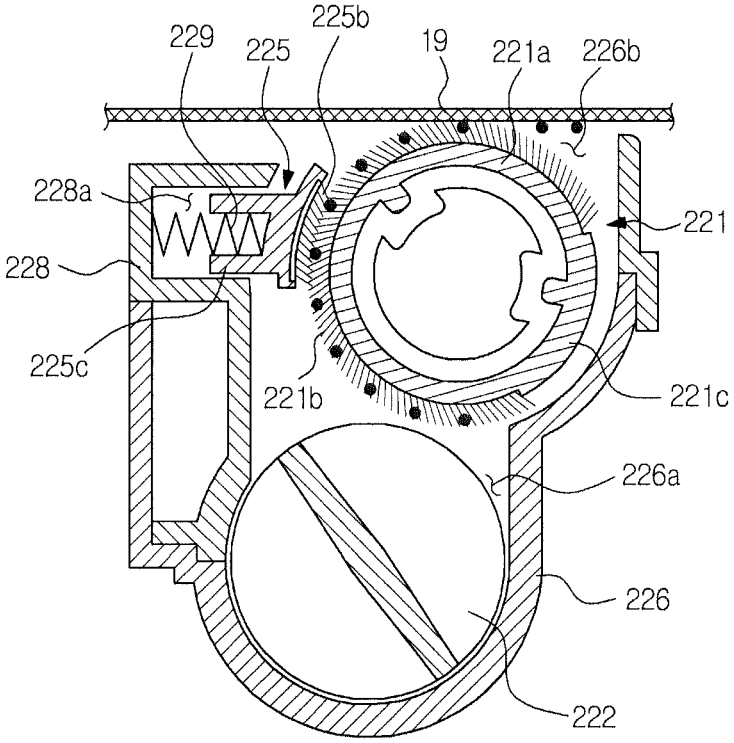

Once the brush 221 has reached the reference position, the filter 19 may be rotated once by approximately 360° or 360° by the filter drive motor 24*a* and simultaneously, the brush 221 may be rotated by a first angle less than approximately 360° or 360° as illustrated in FIG. 15 so as to clean the filter 19 by the brush files 221*b*. In the present embodiment, while the filter 19 is rotated once, the brush 221 may be rotated by approximately 150° or 150° counterclockwise in a first direction.

Figure 16:
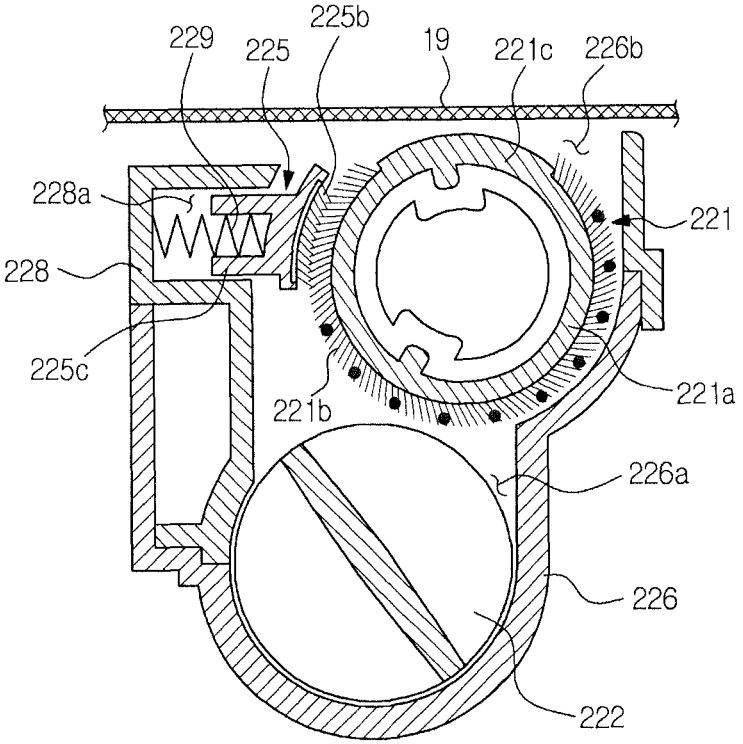

After completing cleaning of the filter 19, the brush 221 may be rotated in the first direction by a second angle such that the brush files 221*b* used to clean the filter 19 pass through the brush cleaner 225 as illustrated in FIG. 16. In the present embodiment, if the brush 221 is rotated in the first direction by approximately 110° or 110° in consideration of the width of the cleaning zone 225*a* of the brush cleaner 225, the brush files 221*b* used to clean the filter 19 begin to pass through the brush cleaner 225.

Then, if the brush 221 is rotated clockwise in a second direction opposite to the first direction, dust adhered to the brush files 221*b* may be removed from the brush files 221*b* by the cleaner files 225*b* of the brush cleaner 225, which results in cleaning of the brush files 221*b*.

In this case, since the cleaner files 225*b* are gradually contaminated by the dust removed from the brush files 221*b* over time, there occurs a situation in which the cleaner files 225*b* may no longer effectively clean the brush files 221*b* due to a great quantity of dust being adhered thereto by sequential cleaning of the brush files 221*b* by the cleaner files 225*b*.

Figure 17:
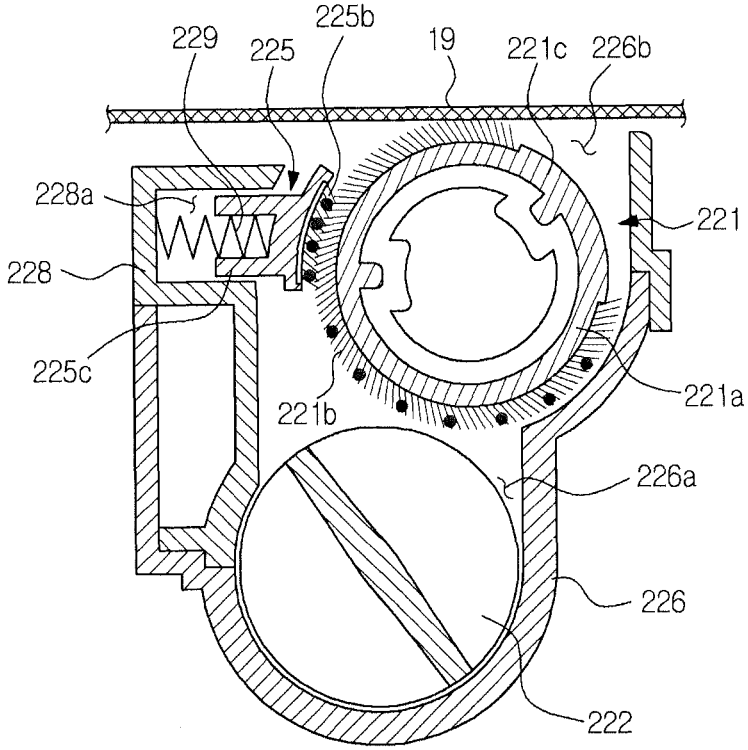
Figure 18:
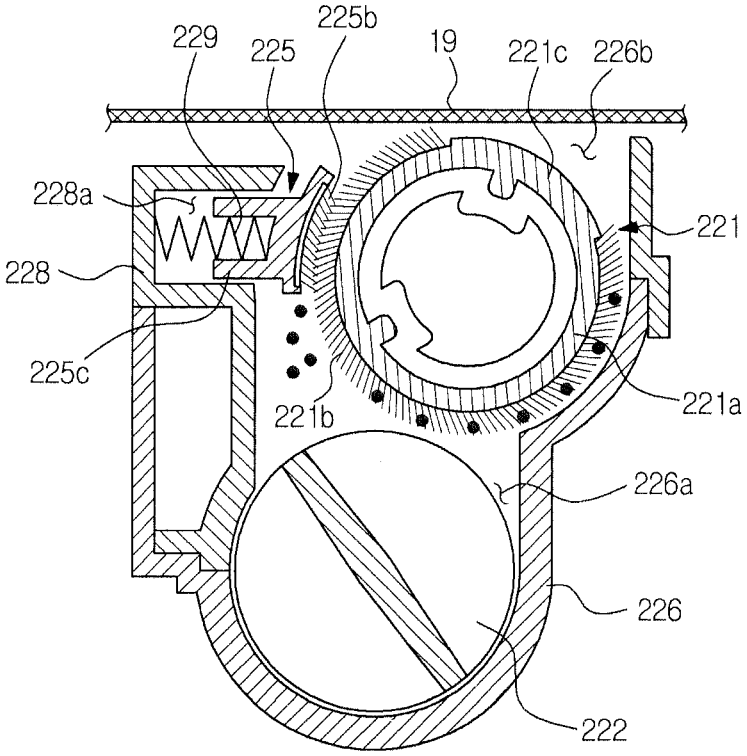

Accordingly, in the present embodiment, cleaning of the brush 221 by the brush cleaner 225 and cleaning of the brush cleaner 225 by the brush 221, are alternately implemented. Specifically, when the brush 221 is rotated clockwise in the second direction by a third angle as illustrated in FIG. 17, the brush files 221*b* are cleaned by the brush cleaner 225. When the brush 221 is rotated counterclockwise in the first direction by a fourth angle less than the third angle as illustrated in FIG. 18, the cleaner files 225*b* are cleaned by the brush 221. In the present embodiment, the brush 221 may be rotated in the second direction by approximately 60° or 60° to allow the brush files 221*b* to be cleaned by the cleaner files 225*b* and subsequently, may be rotated in the first direction by approximately 30° or 30° to allow the cleaner files 225*b* to be cleaned by the brush files 221*b*. As such, the brush files 221*b* arranged on the brush 221 are sequentially cleaned whenever rotated by approximately 30° or 30°.

By alternately repeating an operation of rotating the brush 221 by the third angle to allow the brush files 221*b* to be cleaned by the brush cleaner 225 and an operation of rotating the brush 221 counterclockwise in the first direction by the fourth angle less than the third angle to clean the cleaner files 225*b* as illustrated in FIG. 18, the brush files 221*b* of the entire brush 221 are completely cleaned.

As is apparent from the above description, in a ceiling embedded type air conditioner according to the exemplary embodiments disclosed herein, dust accumulated on a filter may automatically and periodically be removed by a cleaning unit and the removed dust may be stored in a dust storage unit, which eliminates a need to separate and clean the filter.

Moreover, even dust adhered to a brush used to clean the filter may be removed by a brush cleaner, which ensures efficient cleaning of the filter by the brush.

The disclosure herein has provided example embodiments of a ceiling embedded type air conditioner having a filter cleaning device to clean a filter, however the disclosure is not so limited to specific embodiments. For example, the main body frame of the ceiling embedded type air conditioner has been described as being in the form of a substantially square box, however the ceiling embedded type air conditioner may be in a different form. Additionally, different rotation angles have been disclosed herein regarding rotation of the brush. However, it will be understood by those of ordinary skill in the art that the rotation angles may be adjusted, so long as dust accumulated on the filter may be removed, and dust can be removed from the brush using the brush cleaner.

Accordingly, although the embodiments disclosed herein have been shown and described, it would be appreciated by those skilled in the art that changes may be made to these embodiments without departing from the principles and spirit of the invention, the scope of which is defined by the claims and their equivalents.

What is claimed is:

1. A ceiling embedded type air conditioner comprising:

a main body frame having an open bottom;

a ceiling panel defining the bottom of the main body frame and having an air suction opening and an air discharge opening;

a filter disposed inside the suction opening to capture dust introduced through the suction opening; and a filter cleaning device to clean the filter, wherein the filter cleaning device includes a cleaning unit to remove dust from the filter and a dust storage unit to store dust removed by the cleaning unit, wherein the dust storage unit includes a dust sump having an open top to store dust therein, a sump cover to cover the top of the dust sump, and wherein the cleaning unit includes a brush to remove dust from the filter and a transfer auger to transfer dust removed by the brush into the dust storage unit.

2. The air conditioner according to claim 1, wherein the dust storage unit further includes a pair of transparent caps spaced apart from each other, in which the light emitting part and the light receiving part are respectively accommodated.

3. The air conditioner according to claim 2, wherein the transparent caps protrude into the dust sump through sensor holes of the sump cover.

4. The air conditioner according to claim 3, wherein if light from the light emitting part does not reach the light receiving part, a dust sensor indicates that the dust sump is full of dust.

5. The air conditioner according to claim 1, further comprising a dust discharge guide unit installed to the dust sump to allow dust to be discharged from the dust sump.

6. The air conditioner according to claim 5, wherein the dust discharge guide unit includes:

a dust discharge guide having a dust discharge hole;

a support bracket installed to the dust sump so as to vertically movably support the dust discharge guide via an elastic discharge guide member; and an opening/closing member to open or close the dust discharge hole according to vertical movement of the dust discharge guide.

7. The air conditioner according to claim 6, wherein the opening/closing member includes an opening/closing portion configured to open or close the dust discharge hole, a plurality of hinges provided at opposite sides of the opening/closing portion and each having a hinge pin rotatably coupled to the dust discharge guide, and a cam piece adjacent to each hinge pin, and wherein the support bracket includes a rotating guide piece adapted to support the cam piece upon upward movement of the dust discharge guide, to allow the opening/closing member to be rotated.

8. The air conditioner according to claim 7, wherein the dust sump includes a dust discharge port having a center through-hole, to which the dust discharge guide is vertically movably connected, and wherein the dust discharge guide includes a domed portion having an arc-shaped cross section to protrude downward beyond the through-hole, and a retainer portion provided around the domed portion so as to be caught by a portion of the dust discharge port adjacent to the through-hole.

9. The air conditioner according to claim 5, wherein the dust sump includes an air suction hole through which air is introduced into the dust sump, and wherein the dust storage unit contains an air guide to guide the air introduced through the air suction hole to a bottom surface of the dust sump.

10. The air conditioner according to claim 9, wherein the air guide includes a filter portion disposed inside the air suction hole to cover the air suction hole and an air guide portion inclined downward from an upper end of the filter portion into the dust sump.

11. A ceiling embedded type air conditioner comprising:

a main body frame having an open bottom;

a ceiling panel defining the bottom of the main body frame and having an air suction opening and an air discharge opening;

a filter disposed inside the suction opening to capture dust introduced through the suction opening;

a brush, which rotates in first and second directions, to remove dust from the filter;

a brush cleaner installed to be movable toward the brush to remove dust from the brush; and a filter cleaning device to clean the filter, wherein the filter cleaning device includes a cleaning unit to remove dust from the filter and a dust storage unit to store dust removed by the cleaning unit, and wherein the cleaning unit includes the brush and a transfer auger to transfer dust removed by the brush into the dust storage unit;

transferring dust removed by the brush into a dust storage unit by a transfer auger.

12. The air conditioner according to claim 11, further comprising an elastic cleaner support member to move the brush cleaner toward the brush.

13. The air conditioner according to claim 11, wherein the brush includes brush files to remove dust from the filter, and wherein the brush cleaner includes cleaner files to remove dust from the brush files.

14. The air conditioner according to claim 13, wherein the cleaner files tilt downward, and the brush files tilt in a circumferential direction to remove dust from the filter or to allow the cleaner files to remove dust from the brush files according to a rotating direction of the brush.

15. The air conditioner according to claim 14, wherein the transfer auger includes a shaftless auger.

16. The air conditioner according to claim 11, wherein the cleaning unit includes a cleaner guide in which the brush cleaner is movably inserted and a cleaning unit case, wherein the cleaning unit case comprises a lower auger accommodating region in which the transfer auger is disposed and an upper brush accommodating region in which the brush is disposed, and the cleaner guide is disposed at one side of the cleaning unit case to define a sidewall of the lower auger accommodating region and the brush accommodating region.

17. The air conditioner according to claim 13, wherein the brush includes a cylindrical base in which the brush files are disposed, and the base includes a blank portion in which the brush files are not disposed to prevent reattachment of dust removed by the brush files.

18. A ceiling embedded type air conditioner comprising:

a main body frame having an open bottom;

a ceiling panel defining the bottom of the main body frame and having an air suction opening and an air discharge opening;

a filter disposed inside the suction opening to capture dust introduced through the suction opening; and a filter cleaning device to clean the filter, wherein the filter cleaning device includes a cleaning unit to remove dust from the filter and a dust storage unit to store dust removed by the cleaning unit, and wherein the dust storage unit includes:

a dust sump to store dust therein, the dust sump having an air suction hole through which air is introduced into the dust sump, an air guide to guide the air introduced through the air suction hole to a bottom surface of the dust sump, a photo sensor having a light emitting part and a light receiving part spaced apart from each other to sense dust accumulated in the dust sump, and a dust discharge port formed in a bottom of the dust stump to discharge the dust.

19. The air conditioner according to claim 18, wherein the air guide includes a filter portion disposed inside the air suction hole to cover the air suction hole and an air guide portion inclined downward from an upper end of the filter portion into the dust sump.

20. A filter cleaning method of a ceiling embedded type air conditioner comprising:

rotating a brush in a first direction by a first angle to clean a filter using brush files of the brush;

rotating the brush in the first direction by a second angle to allow the brush files to pass through a brush cleaner;

rotating the brush in a second direction opposite to the first direction by a third angle to allow the brush files to be cleaned by the brush cleaner using cleaner files of the brush cleaner;

rotating the brush in the first direction by a fourth angle less than the third angle to allow the cleaner files to be cleaned by the brush; and transferring dust removed by the brush into a dust storage unit by a transfer auger.

21. The method according to claim 20, wherein the rotating the brush in the second direction opposite to the first direction by the third angle to allow the brush files of the brush to be cleaned by the brush cleaner, and the rotating the brush in the first direction by the fourth angle less than the third angle to allow the cleaner files of the brush cleaner to be cleaned by the brush, are alternately repeated.

22. The method according to claim 20, further comprising:

determining, using a sensor, whether the brush is at an initial position prior to the rotating the brush by the first angle; and if the brush is not at the initial position, rotating the brush until the brush reaches the initial position.

23. A ceiling embedded type air conditioner comprising:

a main body frame having an open bottom;

a ceiling panel defining the bottom of the main body frame and having an air suction opening;

a filter disposed inside the suction opening to capture dust introduced through the suction opening; and a filter cleaning device to clean the filter, wherein the filter cleaning device includes a cleaning unit to remove dust from the filter and a dust storage unit to store dust removed by the cleaning unit, wherein the cleaning unit includes a brush which rotates in first and second directions, removes dust from the filter, and a brush cleaner disposed in the cleaning unit adjacent to the brush, wherein the dust storage unit includes a dust sump having an open top to store dust received from the cleaning unit, a sump cover to cover the top of the dust sump, and a dust discharge port formed in a bottom of the dust sump to discharge the dust.

24. The air conditioner according to claim 1, wherein the dust storage unit further includes a dust sensor to sense dust accumulated in the dust sump, and the dust sensor includes a photo sensor having a light emitting part and a light receiving part spaced apart from each other.

* * * * *